US008375507B2

(12) United States Patent
Lee et al.

(10) Patent No.: US 8,375,507 B2
(45) Date of Patent: Feb. 19, 2013

(54) VACUUM CLEANER WITH DETACHABLE CORD REEL UNIT

(75) Inventors: Byung-Jo Lee, Gwangju (KR); See-hyun Kim, Gwangju (KR); Jang-keun Oh, Gwangju (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 436 days.

(21) Appl. No.: 12/749,604

(22) Filed: Mar. 30, 2010

(65) Prior Publication Data

US 2010/0319157 A1 Dec. 23, 2010

(30) Foreign Application Priority Data

Jun. 22, 2009 (KR) ..... 10-2009-0055307

(51) Int. Cl.
*A47L 9/26* (2006.01)

(52) U.S. Cl. ..... 15/323; 15/DIG. 10; 191/12.2 A; 191/12.4

(58) Field of Classification Search ..... 15/319, 15/323, DIG. 10; 191/12 R, 12.2 R, 12.4, 191/12.2 A; *A47L 9/26*
See application file for complete search history.

(56) References Cited

U.S. PATENT DOCUMENTS

| | | | | |
|---|---|---|---|---|
| 2,964,777 | A * | 12/1960 | Allen et al. | 15/323 |
| 3,011,033 | A * | 11/1961 | Belicka et al. | 191/12.2 R |
| 6,052,862 | A * | 4/2000 | Lowery | 15/323 |
| 7,490,706 | B2 * | 2/2009 | Robertson et al. | 191/12.2 R |
| 2002/0032947 | A1 * | 3/2002 | Oh et al. | 15/323 |
| 2008/0295275 | A1 * | 12/2008 | Yoo et al. | 15/300.1 |
| 2009/0078812 | A1 * | 3/2009 | Cho et al. | 242/400 |

FOREIGN PATENT DOCUMENTS

| | | |
|---|---|---|
| JP | 04-322116 | 11/1992 |
| JP | 2001-112682 | 4/2001 |
| JP | 2001-161613 | 6/2001 |
| JP | 2001-169972 | 6/2001 |
| KR | 20-1997-0029481 | 5/1999 |

* cited by examiner

*Primary Examiner* — Brian Glessner
*Assistant Examiner* — Brian D Mattei
(74) *Attorney, Agent, or Firm* — NSIP Law

(57) ABSTRACT

A vacuum cleaner having a detachable cord reel unit is provided. The vacuum cleaner includes a main body, a brush assembly connected to the main body and, a cord reel unit attachable to and detachable from a discharging portion of the main body, the cord reel unit comprising a power cord and a cooling fan formed therein, wherein the cooling fan stops driving automatically when the cord reel unit is mounted in the main body, and the cooling fan starts driving automatically to cool the power cord when the cord reel unit is detached from the main body.

8 Claims, 6 Drawing Sheets

VACUUM CLEANER WITH DETACHABLE CORD REEL UNIT

CROSS-REFERENCE TO RELATED APPLICATION(S)

This application claims the benefit under 35 U.S.C. §119 (a) of Korean Patent Application No. 10-2009-0055307, filed on Jun. 22, 2009, in the Korean Intellectual Property Office, the entire disclosure of which is incorporated herein by reference for all purposes.

BACKGROUND

1. Field

The following description relates to a vacuum cleaner, and more particularly, to a vacuum cleaner having a detachable cord reel unit.

2. Description of the Related Art

An upright or canister type vacuum cleaner may generally be driven by external power to generate a suction force with a fan motor unit mounted therein to draw in an air stream. Foreign substances may be removed from the air stream by way of a centrifuge as the air stream and foreign substances are drawn from a surface being cleaned. This type of vacuum cleaner may employ a cord reel unit to house therein a reel of power cord that is generally long enough to enable the vacuum cleaner to cover a sufficient area.

The cord reel unit may be located on an internal air discharge passage of the vacuum cleaner to cool heat generated from the power cord.

However, the cord reel unit on the internal discharge passage of the vacuum cleaner may generate a problem if it obstructs outgoing air stream. Additionally, since the cord reel unit is housed inside the vacuum cleaner, the cord reel unit may be influenced by internal heat of the vacuum cleaner.

Korean Utility Model Publication No. 1999-0016097 ("KR '097"), Japanese Patent Publication No. 2001-161613 ("JP '613"), Japanese Patent Publication No. 2001-169972 ("JP '972"), Japanese Patent Publication No. 2001-112682 ("JP '682"), and Japanese Patent Publication No. 4-322116 ("JP '116") propose solutions for problems related with the cord reel unit of the vacuum cleaner mentioned above.

KR '097 pertains to a structure in which the cord reel unit is separable from the vacuum cleaner during cleaning operation.

Since the cord reel unit is separable from the vacuum cleaner during cleaning, the cord reel unit does not obstruct the outgoing air stream of the vacuum cleaner, and the vacuum cleaner may have improved discharge and cleaning efficiency.

JP '613, JP '972, JP '682, and JP '116 are directed to a vacuum cleaner including a separate cooling fan that is attached within the cord reel unit. The cooling fan may remove heat from the power cord of the cord reel unit, increase exhaust pressure and may thereby resolve the problem of deteriorated exhaustion.

However, there are several drawbacks to arrangements in the above references. For example, KR '097 is not able to remove the heat generated from the detached cord reel unit efficiently.

Heat irradiated from the cord reel unit is in proportion to the square of the electric current. This means that the possibility of serious accidents such as short circuit or fire increases. This risk may increase, for example, in areas such as North America or Japan, since electric current increases and thus more heat is generated in these areas, as 120V is the standard in North America, and 110V in Japan.

JP '613, JP '972, JP '682, and JP '116 may remove heat generated from the cord reel unit efficiently, since a separate cooling fan is provided inside the cord reel unit. However, since the cord reel unit is kept in the vacuum cleaner, the weight of the vacuum cleaner increases and the cleaning efficiency degrades as it becomes inconvenient for a user to carry the vacuum cleaner. Additionally, the user may have increased fatigue.

SUMMARY

In one general aspect, there is provided a vacuum cleaner which includes a main body, a brush assembly connected to the main body, and a cord reel unit attachable to and detachable from a discharging portion of the main body, the cord reel unit including a power cord and a cooling fan formed therein. The cooling fan stops driving automatically when the cord reel unit is mounted in the main body, and the power cord may be cooled by air stream discharged through the discharging portion, and the cooling fan starts driving automatically to cool the power cord when the cord reel unit is detached from the main body.

The discharging portion may be recessed inward the main body so that the cord reel unit is mounted therein, and the discharging portion may include a hooking portion formed thereon to secure the cord reel unit in place.

The cord reel unit may include a supporting portion provided on the cord reel unit to contact an inner surface of the hooking portion to releasably attach the cord unit to the discharging portion.

The cord reel unit may include a motor having a motor shaft driving the cooling fan, a connecting pipe surrounding the motor shaft, a reel having the power cord coiled therein, the reel being connected to an outer circumference of the connecting pipe, and a front cover and rear cover to cover the cooling fan, the motor, the connecting pipe and the reel. The reel and the motor shaft may be rotated independently from each other.

The power cord may include a power input terminal and a plug, and the rear cover may include a feed port through which the plug is drawn out, and a plug securing portion to secure the plug in place.

The connecting pipe may include a tubular bearing member, and a flange connected to an end of the tubular bearing member.

The vacuum cleaner may further include a switch formed on an outer surface of the front cover or the rear cover to drive the cooling fan when the cord reel unit is detached from the main body, or to stop the cooling fan when the cord reel unit is attached to the main body.

The tubular bearing member of the connecting pipe may extend through a reel center hole, and may thereby rotatably connected to the reel.

The main body may include a power input portion, and the power cord, at one end, may include a power input terminal that is selectively engageable with the power input portion.

In another aspect, there is provided a cord reel unit for a vacuum cleaner including a front cover, a rear cover, a reel, a power cord disposed on the reel, a cooling fan, a motor to drive the cooling fan, and a connecting pipe positioned in a center hole of the reel and surrounding a motor shaft. The reel is rotatable independently of the fan.

The motor shaft may be connected to the cooling fan via a male screw portion on the motor shaft to drive the cooling fan.

The connecting pipe may include a tubular bearing member positioned in the center hole of the reel, and the tubular bearing member may include a motor pipe shaft hole through which the motor shaft extends, the reel rotatably connected to the tubular bearing member.

The connecting pipe may further include a flange at one end.

The front and back covers may each include grill portions to allow air flow therethrough.

The motor may positioned on the rear cover.

The front cover and rear cover may be connected to each other by respective connecting portions of the front and rear covers.

The rear cover may include a supporting portion adapted to engage a portion of the vacuum cleaner to releasably attach to the cord reel unit to the vacuum cleaner.

The front or rear cover may include a switch which is adapted to engage the vacuum cleaner, when the cord reel unit is releasably attached to the vacuum cleaner, to prevent operation of the cooling fan, and is adapted to be disengaged from the vacuum to cleaner when the cord reel unit is removed from the vacuum cleaner to allow operation of the cooling fan.

Other features and aspects will be apparent from the following detailed description, the drawings and the claims.

Figure 1:
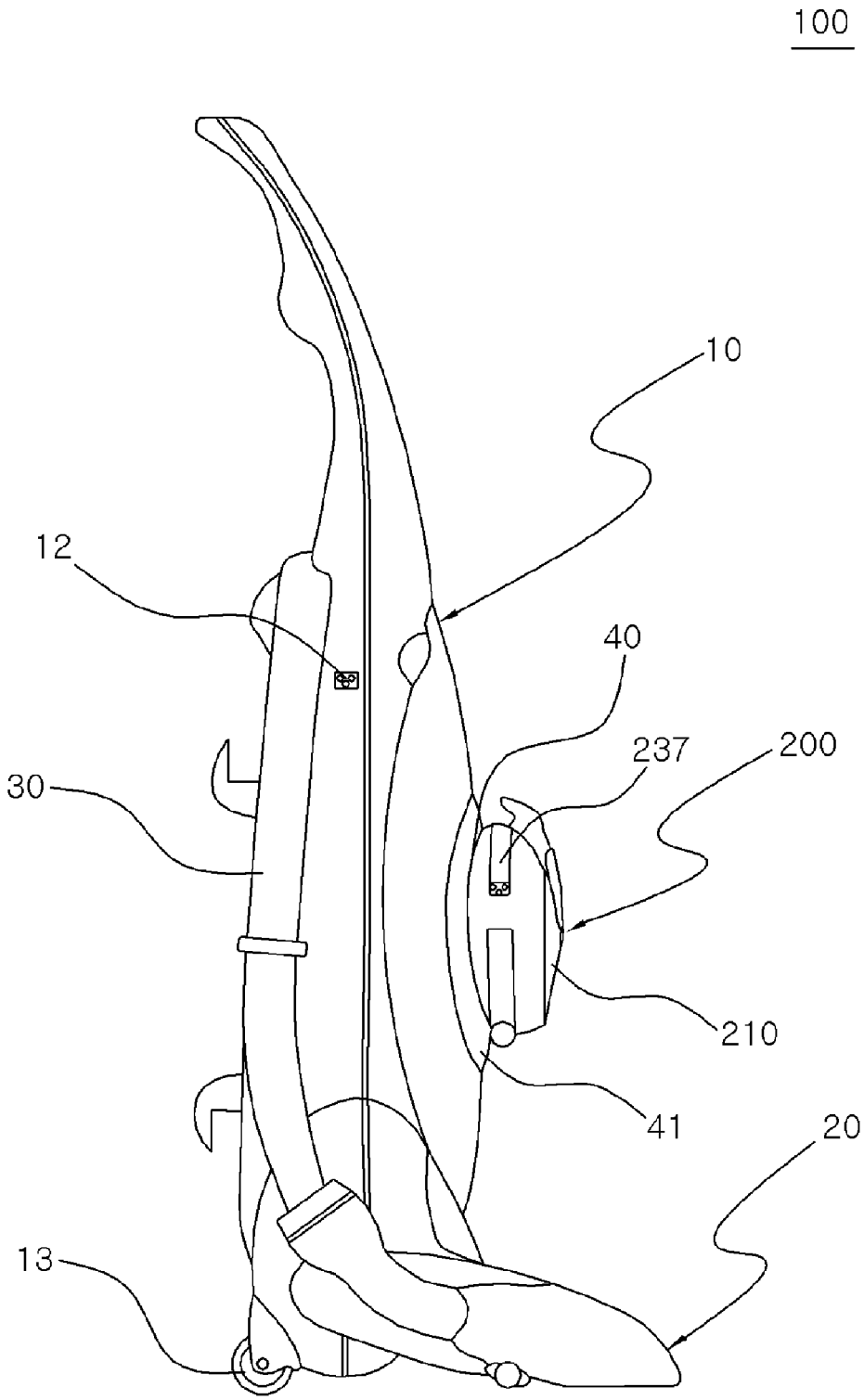
FIG. 1 is a left side view illustrating an example of a vacuum cleaner having a detachable cord reel unit.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

The following detailed description is provided to assist the reader in gaining a comprehensive understanding of the methods, apparatuses, and/or systems described herein. Accordingly, various changes, modifications, and equivalents of the systems, apparatuses, and/or methods described herein will be suggested to those of ordinary skill in the art. The progression of processing steps and/or operations described is an example; however, the sequence of and/or operations is not limited to that set forth herein and may be changed as is known in the art, with the exception of steps and/or operations necessarily occurring in a certain order. Also, descriptions of well-known functions and constructions may be omitted for increased clarity and conciseness.

Figure 2:
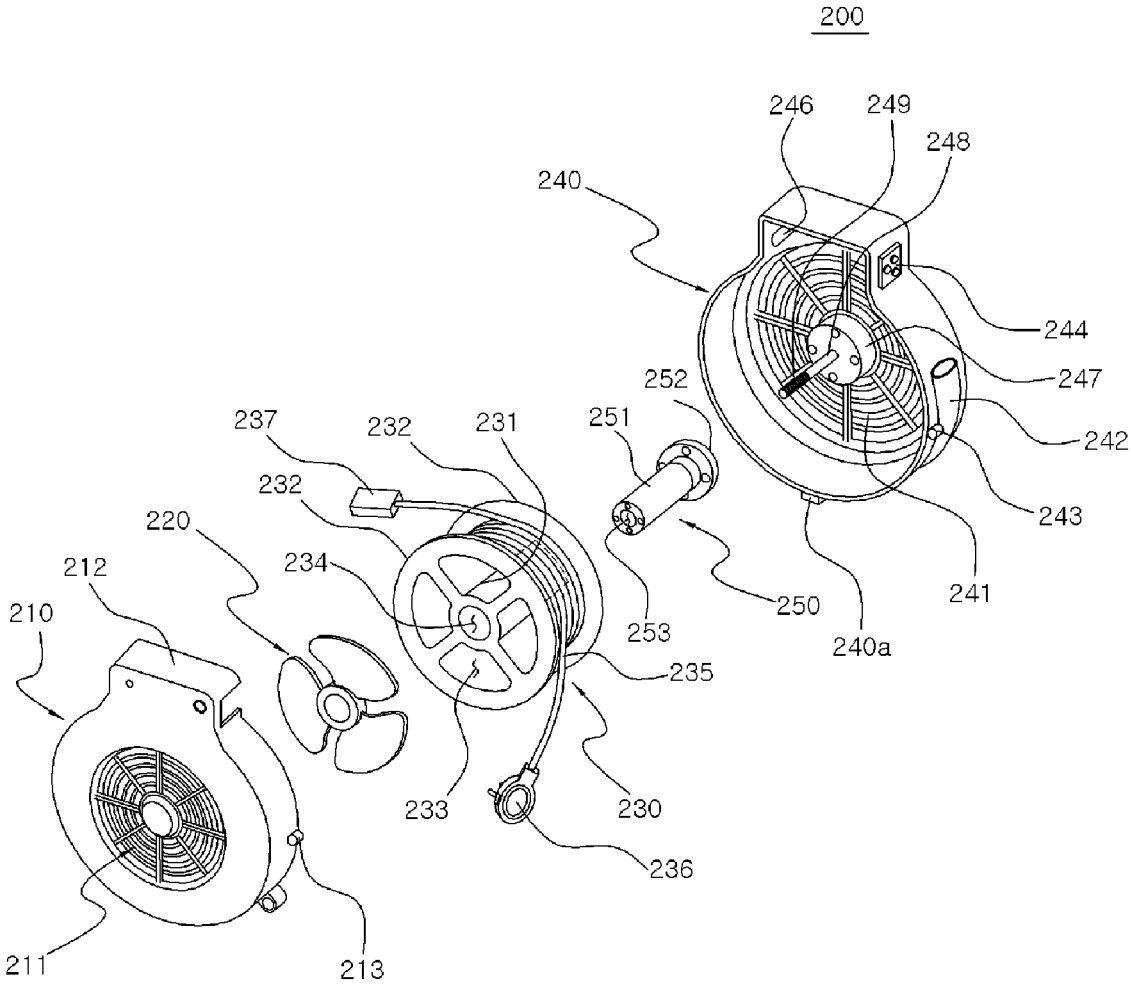
FIG. 2 is an exploded perspective view illustrating an example of the detachable cord reel unit.
Figure 3:
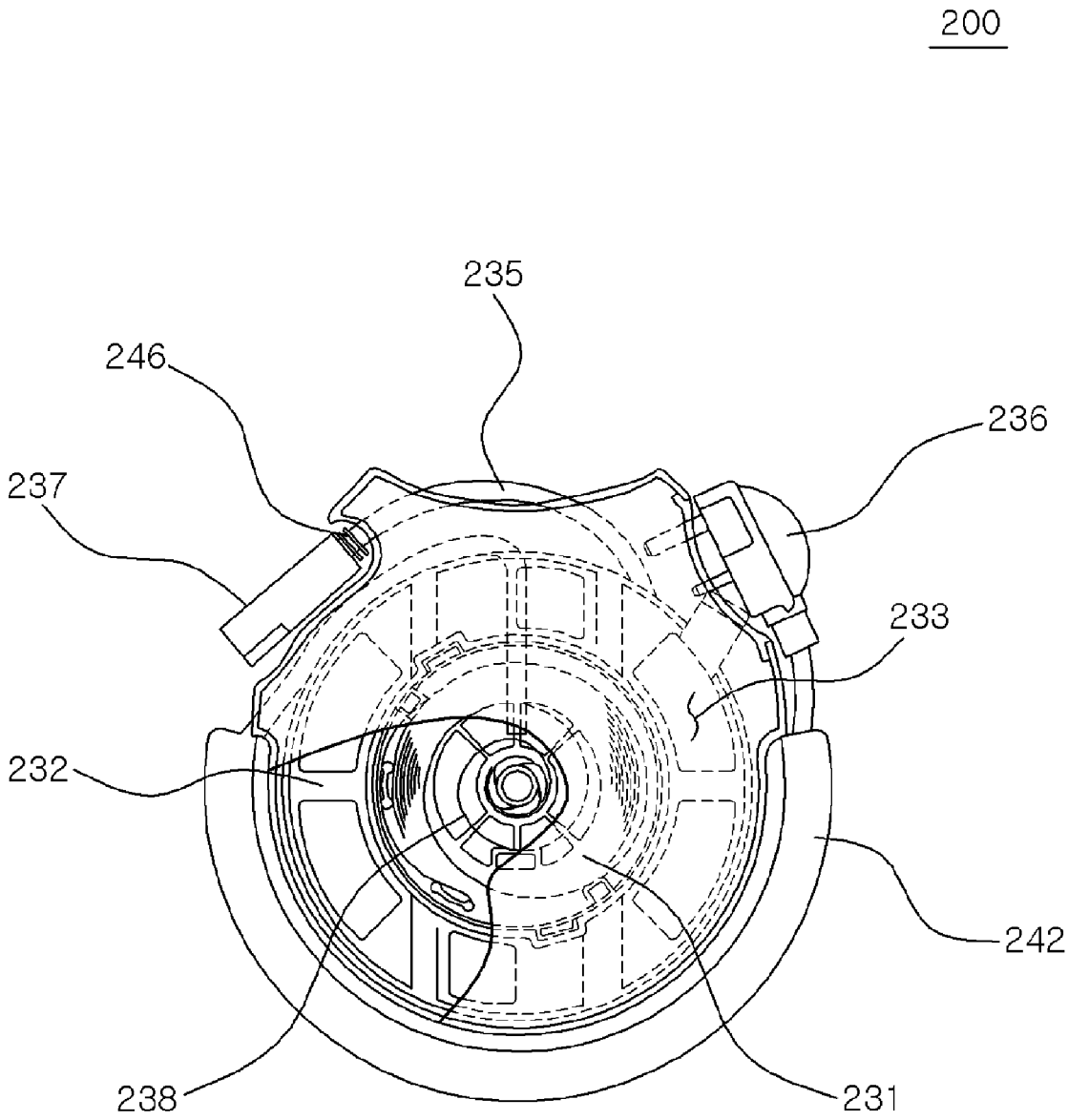
FIG. 3 is a partial cross section view illustrating an example of the detachable cord reel unit from which a cooling fan is omitted to explain detailed structure of the detachable cord reel unit.
Figure 4:
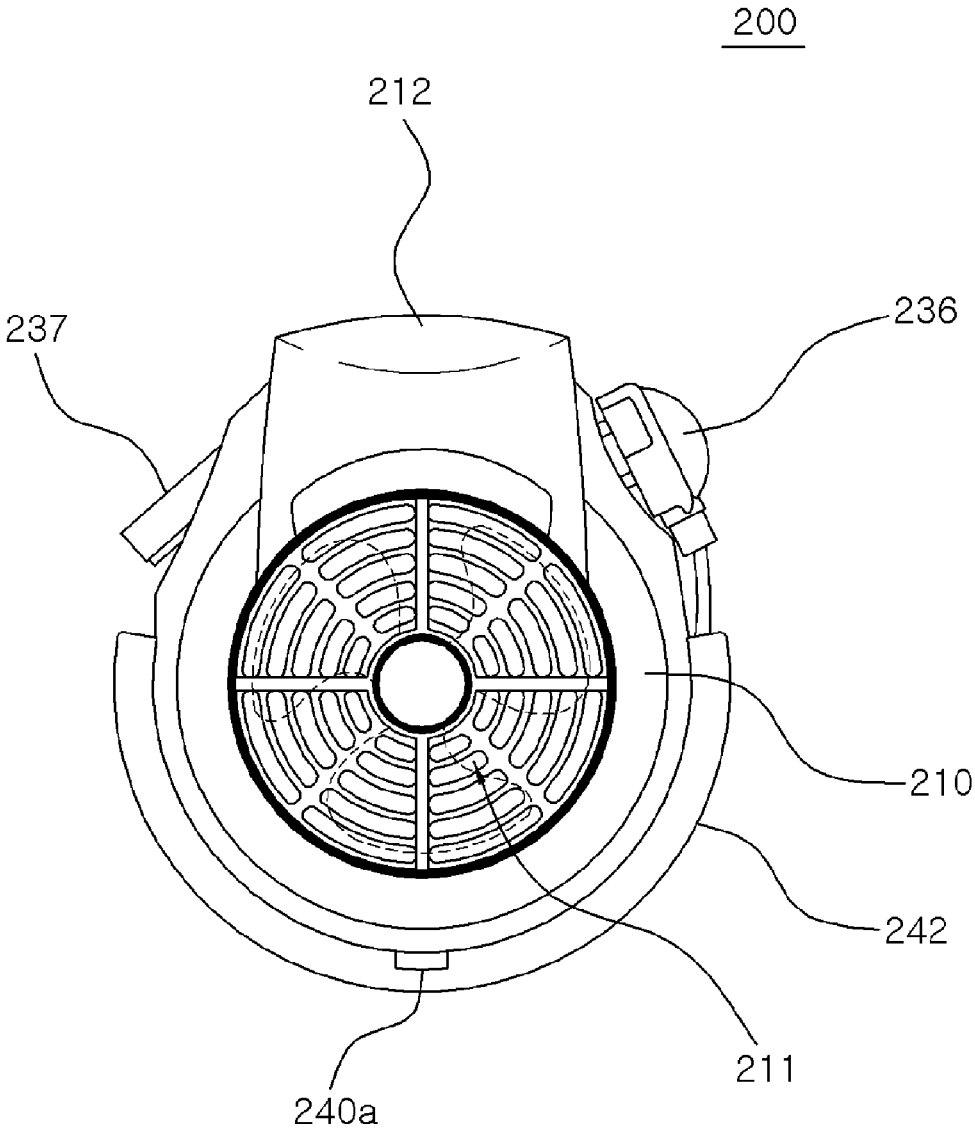
FIG. 4 is a front view illustrating an example of the detachable cord reel unit.
Figure 5:
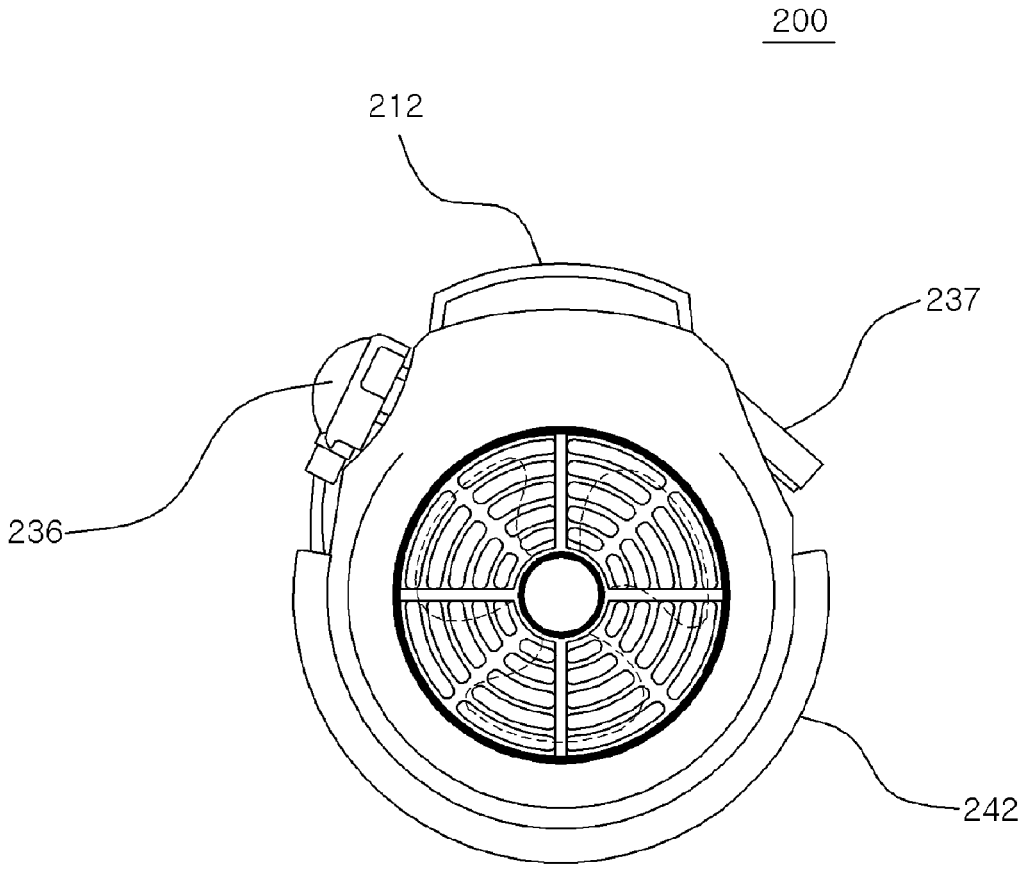
FIG. 5 is a rear view illustrating an example of the detachable cord reel unit.

FIG. 1 illustrates a left side view of an example vacuum cleaner 100 having a detachable cord reel unit 200. FIG. 2 illustrates an exploded perspective view of an example of the detachable cord reel unit 200. FIG. 3 illustrates a partial cross section view of an example of the detachable cord reel unit 200 from which a cooling fan 220 is omitted to explain detailed structure of the cord reel unit 200. FIG. 4 illustrates a front view of an example of the detachable cord reel unit 200, and FIG. 5 illustrates a rear view of an example of the detachable cord reel unit 200.

Referring to FIG. 1, for example, the vacuum cleaner 100 includes a main body 10, a brush assembly 20, a hose 30 to connect the main body 10 to the brush assembly 20, and a cord reel unit 200 detachably attached to a discharging portion 40 of the main body 10.

The main body 10 houses an impeller (not illustrated) to generate a suction force, a motor (not illustrated), and a dust separating apparatus (not illustrated). The discharging portion 40, to which the cord reel unit 200 is detachably attached, may be formed on the rear surface of the main body 10.

The main body 10 also includes a power input portion 12 to which a power input terminal 237 of the cord reel unit 200 may be connected.

The discharging portion 40 may discharge an air stream out of the vacuum cleaner after foreign substances, such as dusts, are separated from the air stream in the dust separating apparatus (not illustrated). The discharging portion 40 is inwardly recessed from an outer surface of the main body 10 so that the cord reel unit 200 is mounted therein. The discharging portion 40 also includes a hooking portion 41 extended with a predetermined width from a lower outer circumference of an entrance to a center of the discharging portion 40 so that the cord reel unit 200 mounted in the discharging portion 40 is fixedly hooked thereto.

The brush assembly 20 is constructed to draw in external air stream along with foreign substances, such as dusts, using a suction force generated inside the main body 10. The main body 10 may be rotatably connected to an upper portion of the brush assembly 20. The main body 10 and the brush assembly 20 are connected to each other through the hose 30. Wheels 13 may be provided on a lower portion of the brush assembly 20, allowing a user to carry the vacuum cleaner 100 around and do the cleaning easily.

Referring to FIGS. 2 to 5, for the purposes of example, the cord reel unit 200 includes a front cover 210, a cooling fan 220, a reel 230, a rear cover 240, and a connecting pipe 250.

The front cover 210 may include a handle 212 formed on an upper portion, a front grill 211 formed on a front side to help air exhaustion, and one or more connecting members 213 formed on a side.

The reel 230 may include a drum shaft 231 to wind or unwind the power cord 230 by rotating in a forward or backward direction, side plates 232 connected to both ends of the drum shaft 231, each of the side plates 232 having a plurality of holes 233 provided for air exhaustion, and a power cord 235 wound around the drum shaft 231.

One end of the power cord 235 may be connected to a plug 236 which may be connected to a socket for receiving external power supply, and the other end may be connected to a power input terminal 237 which is connected to the power input portion 12 of the vacuum cleaner 100 to supply external power to the vacuum cleaner 100.

With reference to FIG. 3, the reel 230 may also include an elastic member 238 imparting an elastic recovery force, such that the reel rotates in a forward or backward direction due to the elastic recovery force.

The connecting pipe 250 may include a tubular bearing member 251, and a flange 252 connected to an end of the tubular bearing member 251.

The connecting pipe 250 may be inserted in a reel center hole 234, so that the reel 230 is rotatably connected to an outer circumference of the connecting pipe 250. The reel may be connected to the rear cover 240 as the motor shaft 249 is inserted into a motor pipe shaft hole 253 and the flange 252 is fixed to the outer surface of the motor 247. As explained above, since the reel 230 is connected to the motor 247 or the rear cover 240 through the connecting pipe 250, the reel 230 is rotatable independently from the motor shaft 248.

The rear cover 240 may include a rear grill 241 formed in a middle surface for air exhaust, a motor 247 formed in an inner center to generate a rotating force to rotate the cooling fan 220, and a switch 240*a* to turn on or off the motor 247 in accordance with the attachment or detachment of the cord reel unit 200. The switch 240*a* may apply any proper known contact or contactless technique, including optical sensor switch, magnet switch, touch switch, or limit switch, for example.

A plurality of connecting members 243 may be formed on an outer surface of the rear cover 240 to be connected with the connecting member 213 of the front cover 210. Additionally, a plug securing portion 244 to fix a plug 236 of the power cord 235, and a power cord feeding hole 246 through which the power cord 235, connected to the power input terminal 237, may be drawn out. The plug securing portion 244 and the power cord supply hole 246 may be formed on both upper sides of the rear cover 240.

A supporting portion 242 may be formed on a side surface and a lower surface of the rear cover to guide the power cord 235 when the power cord 235 is drawn out or in. When the cord reel unit 200 is insertingly seated in the discharging portion 40, the supporting portion 242 may be brought into a tight contact with an inner surface of the hooking portion 41 to thereby releasably attach the cord reel unit 200 to the discharging portion 40. In this configuration, the cord reel unit is prevented or deterred from inadvertently separating from the discharging portion 40.

The switch 240*a* may be formed on the lower surface of the rear cover 240 to be pressed down and stop the operation of the motor 247 in accordance with the attachment of the cord reel unit 200 to the discharging portion 40 of the vacuum cleaner 100, or be returned back to the original position and start driving the motor 247 in accordance with the detachment of the cord reel unit 200 from the vacuum cleaner 100.

The motor shaft 248 of the motor 247 may be protruded through a center of the motor 247. The motor shaft 248 may have a male screw portion 249 formed on an end thereof to be screw-coupled with the cooling fan 220, The motor 247 may be connected to an inner center of the rear cover 240. The motor 247 may be connected to and switched on or off by the switch 240*a*.

In the cord reel unit 200 with the structure explained above, the reel 230 with the power cord 235 coiled therein, may be connected to the rear cover 240. The motor shaft 248 may be passed through the reel center hole 234 which may be formed in a center of the reel 230, and protruded out of the front surface of the reel 230. In such a situation, the reel 230 and the motor shaft 248 may be rotated independently from each other, since the connecting pipe 250 is intervened therebetween.

The cooling fan 220 may be screw-coupled with the male screw portion 249 of the motor shaft 248 that is protruded out of the front surface of the reel 230. The front cover 210 and the rear cover 240 may be connected to each other by the connecting members 213, 243, so that the plug 236 and the power input terminal 237 of the power cord 235 extend and are exposed out of the cord reel unit 200.

Figure 6:
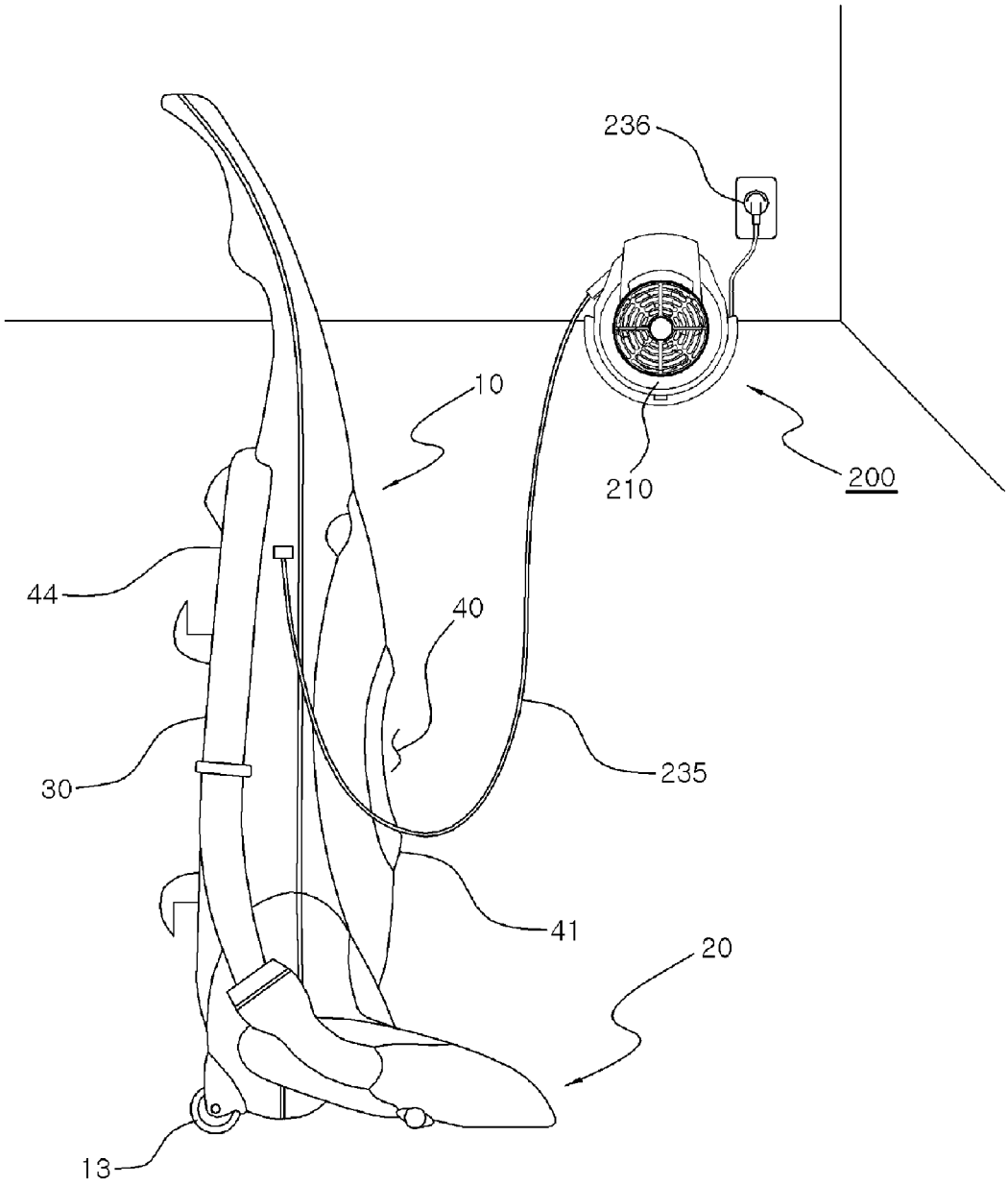
FIG. 6 illustrates the example of a vacuum cleaner of FIG. 1 in use in which the detachable cord reel unit is in a separated position.

FIG. 6 illustrates the example of the vacuum cleaner of FIG. 1, and shows an example of the vacuum cleaner may be used with the detached cord reel unit 200.

As explained above, when not in use, the integrally-assembled cord reel unit 200 may be insertingly seated in the discharging portion 40 of the vacuum cleaner 100, such that the cord reel is releasably attached in the discharging portion. In such a situation, the outer surface of the supporting portion 242 is in a close contact with the inner surface of the hooking portion 41, thereby securely preventing or deterring the cord reel unit 200 from inadvertently separating. Additionally, the switch 240*a* is in contact with the inner surface of the discharging portion 40 to cut a power supply to the motor 247 and thereby stop the operation of the motor 247. In such a situation, the cord reel unit 200 may be cooled by air stream discharged through the discharging portion 40.

If the vacuum cleaner 100 is in operation, as illustrated in FIG. 6, for example, the cord reel unit 200 may be detached from the discharging portion, and as a result, the switch 240*a* may be released and the power may be supplied to the motor 247. Accordingly, the cooling fan 220 within the cord reel unit 200 may be rotated to cool the cord reel unit 200 by creating a flow of air through the cord reel unit 200. The detached cord reel unit 200 may be securely hung on the wall, thereby further improving user convenience.

As explained above, the cooling fan 220 provided inside the cord reel unit 200 may automatically start driving if the cord reel unit 200 is detached from the vacuum cleaner during the cleaning operation or stop driving automatically when the cord reel unit 200 is attached back to the vacuum cleaner. As a result, use of the vacuum cleaner 100 is convenient.

Further, since the cord reel unit 200 may be detached from the vacuum cleaner 100 and separately used, the vacuum cleaner 100 may have a reduced weight, and thereby increase user convenience.

Further still, since the cooling fan 220 mounted in the cord reel unit 200 may efficiently removes the heat generated from the cord reel unit 200, serious accidents such as short circuit or fire may be avoided or deterred especially in the areas where low voltage power is supplied.

A number of examples have been described above. Nevertheless, it will be understood that various modifications may be made. For example, suitable results may be achieved if the described techniques are performed in a different order and/or if components in a described apparatus, system, architecture, device, or circuit are combined in a different manner and/or replaced or supplemented by other components or their equivalents. Accordingly, other implementations are within the scope of the following claims.

What is claimed is:

1. A vacuum cleaner, comprising:

a main body;

a brush assembly connected to the main body; and a cord reel unit attachable to and detachable from a discharging portion of the main body, the cord reel unit comprising a power cord and a cooling fan formed therein;

wherein the cooling fan is configured to stop driving automatically when the cord reel unit is mounted in the main body, wherein the power cord is configured to be cooled by an air stream discharged through the discharging portion, and wherein the cooling fan is configured to start driving automatically to cool the power cord when the cord reel unit is detached from the main body.

2. The vacuum cleaner of claim 1, wherein:

the discharging portion is recessed inward the main body so that the cord reel unit is mounted therein; and the discharging portion comprises a hooking portion formed thereon to secure the cord reel unit in place.

3. The vacuum cleaner of claim 2, wherein the cord reel unit comprises a supporting portion provided on the cord reel unit to contact an inner surface of the hooking portion to releasably attach the cord reel unit to the discharging portion.

4. The vacuum cleaner of claim 1, wherein the cord reel unit comprises:

a motor comprising a motor shaft driving the cooling fan;

a connecting pipe surrounding the motor shaft;

a reel comprising the power cord, the reel being connected to an outer circumference of the connecting pipe; and a front cover and a rear cover configured to cover the cooling fan, the motor, the connecting pipe, and the reel, wherein the reel and the motor shaft are configured to be rotated independently from each other.

5. The vacuum cleaner of claim 4, wherein:

the power cord comprises a power input terminal and a plug; and the rear cover comprises:

a feed port through which the plug is configured to be drawn out; and a plug securing portion to secure the plug in place.

6. The vacuum cleaner of claim 4, wherein the connecting pipe comprises:

a tubular bearing member; and a flange connected to an end of the tubular bearing member.

7. The vacuum cleaner of claim 4, further comprising a switch formed on an outer surface of the front cover or the rear cover, the switch being configured to:

drive the cooling fan when the cord reel unit is detached from the main body; or stop the cooling fan when the cord reel unit is attached to the main body.

8. The vacuum cleaner of claim 6, wherein the tubular bearing member of the connecting pipe extends through a reel center hole, and is thereby rotatably connected to the reel.

* * * * *